US005105835A

United States Patent [19]

Drewett et al.

[11] Patent Number: 5,105,835

[45] Date of Patent: Apr. 21, 1992

[54] SMOKING ARTICLES

[75] Inventors: Christopher G. Drewett; David W. Bassett; Colin A. Hill, all of Bristol, England

[73] Assignee: Imperial Tobacco, Ltd., Bristol, England

[21] Appl. No.: 466,997

[22] Filed: Jan. 18, 1990

[30] Foreign Application Priority Data

Jan. 25, 1989 [GB] United Kingdom ..... 8901579

[51] Int. Cl.[5] ..... A24D 1/10

[52] U.S. Cl. ..... 131/349; 131/364; 131/365

[58] Field of Search ..... 131/364, 360, 365, 349

[56] References Cited

U.S. PATENT DOCUMENTS

| | | | |
|---|---|---|---|
| 2,342,853 | 2/1944 | Furstenberg . | |
| 4,219,031 | 8/1980 | Rainer et al. | 131/340 |
| 4,369,798 | 1/1983 | Jackson . | |
| 4,615,345 | 10/1986 | Durocher | 131/364 X |
| 4,622,983 | 11/1986 | Mathews et al. | 131/364 X |
| 4,679,575 | 7/1987 | Yamaguchi et al. | 131/360 X |
| 4,691,717 | 9/1987 | Ikeda et al. | 131/365 |
| 4,727,888 | 3/1988 | Luke | 131/364 X |
| 4,776,355 | 10/1988 | Stevenson et al. | 131/349 X |
| 4,781,203 | 11/1988 | La Hue | 131/349 X |
| 4,790,332 | 12/1988 | Wallace . | |
| 4,878,507 | 11/1989 | Case et al. | 131/364 X |

*Primary Examiner*—V. Millin
*Assistant Examiner*—J. Doyle
*Attorney, Agent, or Firm*—Larson & Taylor

[57] ABSTRACT

There is provided a smoking article having a mouthpiece 9 and a rod of smoking material 12 wrapped in a wrapper 14. A rod 15 constructed of for example activated carbon is provided within the smoking material 12. Between puffs the smoking material extinguishes leaving the rod 15 smouldering. During each puff the smoking material is reignited by the rod 15.

22 Claims, 10 Drawing Sheets 52
53
51
57
50
54
55
56

SMOKING ARTICLES

This invention concerns smoking articles such as cigarettes and has as its objective the provision of a smoking article in which sidestream smoke is substantially reduced or even eliminated by a means which involves substantially quenching the combustion of the smoking material between puffs and reigniting said smoking material at the instigation of puffing.

The term sidestream smoke is generally used to describe all of the emissions from a smoking article with the exception of those collected and inhaled by the smoker and known as mainstream smoke. In the context of this patent the meaning given to the term sidestream smoke is those emissions which are produced from the burning coal directly to the environment, and specifically those produced during the interval between puffs as distinct from those emissions that occur directly to the environment during puffing.

The literature describes various modifications to wrappers and in particular cigarette papers designed to achieve reductions in sidestream smoke. For example, GB patent 2191930A describes a paper with up to 50% of a high superficial surface area filler and including burn modifier salts. Other examples are described in U.S. Pat. Nos. 4,231,377, 4,420,002 and 4,450,847 and uses of these materials are discussed in patents numbered EP0290911A2, GB2160084,GB2209267A, GB2209268A and GB2209269A. These materials are claimed to provide reductions of up to 70% by weight of the particulate component of sidestream emissions. However, cigarettes using these papers (brand names include PASSPORT previously sold in Canada, VANTAGE EXCEL and VIRGINIA SUPERSLIMS sold in the U.S.A.) consume a large proportion (by weight) of the tobacco during the period between puffs, a proportion comparable to that of conventional cigarettes, i.e. in excess of 50% of the total weight of tobacco is normally consumed. Also the rate at which the sidestream intensity decays immediately after a puff is not satisfactory and the minimum levels of sidestream intensity attained are not as low as is desirable.

It is a further objective of the present invention to substantially reduce the amount of tobacco consumed between puffs, since this tobacco is wasted, of no benefit to the smoker, and increases the total sidestream emissions of the product.

GB patent 2094130A proposes a cigarette wrapper of preferably not more than 2 Coresta units, this being a low permeability compared with conventional cigarette papers and having an accompanying low gas diffusion property. It is claimed that the particular choice of viscous flow permeability and diffusion value per unit thickness enables a reduction of 40 or even 60% in total sidestream particulate matter delivery, compared on an equal puff number basis with comparable cigarettes having conventional cigarette papers. This patent recognises the relationship between inherent permeability and free smoulder rate and the consequent effects upon sidestream emissions. It therefore proposes a need to resort to papers of low inherent permeability but suggests that the lowest values used in conventional cigarette production are about 5 Coresta units, because the use of lower permeabilities has resulted in cigarettes failing to remain alight if left to smoulder for even a short time. The claimed improvement of patent 2094130A is the discovery of cigarette paper properties which enable lower permeability values to be used whilst retaining acceptable combustion sustaining characteristics of the smoking articles. Thus patent 2094130A also results in a product which consumes a relatively high proportion of the total weight of tobacco between puffs.

One aspect of the present invention proposes that the wrapper of the smoking article is specifically chosen such that it arrests free smouldering. Thus without further adaptation articles employing these materials will extinguish within puffing intervals normally associated with human smoking of manufactured cigarettes. This performance may be achieved in a variety of ways including the use of papers described in co-depending patent No. 8912238.6 and by other means such as low inherent permeability and high thermal conductivity wrappers. If paper is used, such papers will typically have inherent permeabilities of less that 5 Coresta and more probably less than 2 Coresta and may be coated or contain additives to reduce permeability and/or adjust combustibility. The inherent permeabilities and gas diffusion properties of the paper wrappers to be found on some East European Papirossi smoking articles would achieve the required conditions. Such Papirossi cigarettes extinguish between puffs if left for periods of time usual in smoking conventional cigarettes, and such a feature is normally unacceptable to smokers.

It is proposed in U.S. Pat. No. 4,219,031 to construct a smoking product comprising a porous self-supporting central core of carbonised fibres, circumscribed by tobacco shreds, in order to provide an improved smoking product of the type containing carbonised material which will exhibit smoking characteristics comparable to conventional cigarettes with lessened deliveries of particulate matter and gas phase components. References in that patent to prior art cite only the problems of construction and smoking experience encountered with previous attempts to design carbon substitute cigarettes. One such reference (U.S. Pat. No. 3,614,956) provides another variation of the use of axial cores in cigarettes. Further embodiments of co-axial cigarettes are described in GB1086443,GB2070409 and U.S. Pat. No. 3,356,094.

The product of U.S. Pat. No. 4,219,031 will burn between puffs like a conventional cigarette and there is no suggestion that the burn characteristics will be modified compared with a conventional cigarette in the aspect of the design.

Thus there are prior proposals known to the applicants to reduce smoke and thus the particulate, vapour and gas phase contributions either during puffing and between puffs, or between puffs alone and thereby reduce the sidestream smoke, but in none of the prior proposals has it been suggested that sidestream smoke can be reduced or even eliminated by substantially quenching the combustion of the smoking material between puffs whilst maintaining combustion of the article itself through the use of an integral clean burning fuel element(s) which will itself free-smoulder for a time period extended beyond that of the extinguished smoking material.

The present invention seeks to reduce the production of sidestream smoke by constructing a smoking article which substantially ceases to consume the smoking material, for example tobacco, between puffs and is designed so that the smoking material is reignited during puffing.

According to one aspect of the present invention, there is provided a smoking article incorporating smoking material the combustion products of which are inhaled by the smoker by puffing, said smoking article being adapted to extinguish the smoking material between puffs, and a combustion source incorporated in the smoking article and adapted to reignite the smoking material during puffs thereby causing the smoking material to combust.

Whilst in its preferred form the smoking material should completely extinguish between puffs, the benefits of the present invention can be achieved by so arranging the components that the smoking material is substantially completely extinguished but not completely extinguished. Essentially, therefore, extinguished should be understood to mean that the smoking material could not, without assistance from an additional ignition source, regenerate a fully burning coal with a single standard puff. Thus, the combustion of the smoking material will be reduced to a level at which sidestream smoke is practically invisible or unnoticeable and that will achieve an acceptable product. In addition, it is preferable that the components of the cigarette be chosen to make the reduction as instantaneous as possible.

It is a feature of the present invention that the smoking article is designed to extinguish the smoking material between puffs. Thus, the reduction in sidestream smoke production and consumption of smoking material between puffs will depend upon the rate at which the burning smoking material is completely or substantially completely extinguished. Smoking material which is in close contact with the clean burning fuel element(s) for the time which this element(s) remains ignited may be subject to a residual level of combustion. Therefore, the most effective and impressive reductions in sidestream smoke are achieved when the smoking material extinguishes most rapidly, bringing about an immediate dependence upon a fuel element as a source of reignition when puffing recommences. However, it will be appreciated that a less impressive performance can be achieved by, for example, suitable choice of the wrapper in which the smoking material is extinguished less rapidly and as a consequence, dependence on the fuel element(s) for reignition of puffing is less immediate. There is therefore a range of performance obtainable within this invention.

According to another aspect of the present invention there is provided a smoking article comprising a rod smoking material incapable of sustaining static combustion and a combustion source capable of sustaining static combustion and thus smouldering for a finite period of time in the absence of static combustion of the smoking material and providing a source of combustion for reigniting the smoking material from time to time during puffing.

The arrangement may be such that the combustion source is adapted to ignite the smoking material during puffing as a consequence of the rapid rise in temperature of the combustion source resulting from the increased oxygen supply and the availability of oxygen to the smoking material during puffing. This action temporarily re-establishes the vigorous combustion reactions. When puffing ceases and the oxygen supply consequently reduces the smoking material will cease to combust and the combustion source will return to a slowly decaying state of smoulder in which virtually only the combustion source remains ignited and virtually no sidestream smoke will be produced. Upon puffing on the smoking article once more, the rapid airflow past the combustion source will repeat the cycle described above.

The principle upon which this invention depends is that of controlling the fragile balance between heat supplied by the oxygen-carbon reaction and heat losses from the burn zone such that the combustion system is no longer self sustaining during free smoulder as occurs in most conventional manufactured cigarettes. An additonal combustion source/fuel element(s), which is chosen to be less quickly quenched than the smoking material during this severely oxygen depleted period, continues to burn beyond the time at which the smoking material itself is substantially completely extinguished. This combustion source provides continuity between puffs and is capable of propogating combustion to the smoking material on activation by puffing.

The smoulder of the heat source will continue for as long as sufficient oxygen supply is available to support this combustion. Preferably, this time period will be in excess of the average duration between puffs normally allowed by the majority of smokers but in certain applications this may be much shorter and in these cases the only requirement is that the interval time to fully extinguish shall be determined by the combustion source and not by the smoking material alone. The choice of materials used for and the construction of the combustion source are critical factors in determining the length of time for which the combustion source will free smoulder when inserted in the rod of smoking material. Example 1 demonstrates the effect of fuel rod dimensions.

Conventional cigarettes rely upon the smoking material combined with the cigarette paper to provide a self-sustaining heat source. This is achieved largely by the choice of cigarette paper such that it provides for sufficient combustion of the smoking material in order to sustain the continued combustion between puffs regardless of the interval time.

One aspect of this invention provides for a wrapper or cigarette paper which by virtue of its combustibility, oxygen diffusivity and/or thermal conductivity prevents the self sustaining free smoulder of the smoking material in the presence of a separate combustion source that is added to provide re-ignition of the smoking material when puffing commences.

According to another aspect of the present invention there is provided a smoking article comprising a rod of smoking material enclosed in a sheath which denies sufficient oxygen supply to the smoking material to sustain combustion of the smoking material in the absence of puffing and a combustion source incorporated in the article and adapted to smoulder for a finite time between puffs and provide a source of combustion for the smoking material when this article is puffed.

Preferably, the smoking article comprises a rod of smoking material enclosed within an outer sheath which restricts static burn of the rod. Thus the outer sheath may be a paper sheath of unusually low porosity and/or combustibility chosen specifically to be below the values which will lead to sustained free smoulder of the smoking material when constructed according to the present invention. Whilst the exact values will depend on several aspects of the construction of the smoking article, for example the density of the smoking material, a suitable cigarette paper would exhibit a Coresta air permeability not greater than 10 ml/min/cm$^2$/K Pa and a more suitable paper would probably exhibit a Coresta air permeability of not greater than 2 ml/min/cm$^2$/K Pa. Indeed, our research has included papers which have such low air permeabilities that the Coresta method is no longer a suitable means of evaluation. In these cases we have used papers with air permeabilities greater than 400,000 gurley seconds.

According to a further aspect of the present invention there is provided a smoking article comprising a rod of smoking material enclosed in a sheath which is wholly or partly constructed of high conductivity or high heat capacity materials so as to conduct or extract heat away from the high temperature oxidation region of the combusting smoking material and thereby assist in achieving rapid extinguishing of the combustion reaction at the cessation of puffing, and a combustion source which continues to burn for a finite time between puffs and act as a source of combustion to reignite the smoking material during puffing.

According to a further aspect of the present invention there is provided a smoking article comprising a rod of smoking material in which the smoking material has been adapted in such a manner as to render it incapable of supporting continuous free smoulder in the absence of puffing, and a combustion source incorporated in the article and adapted to smoulder for a finite time between puffs and provide a source of ignition for the smoking material when this article is puffed.

According to a further aspect of the present invention there is provided a smoking article comprising a rod of smoking material enclosed in a wrapper and incorporating a combustion source whereby the combination of the components renders the rod of smoking material incapable of supporting free smoulder in the absence of puffing.

The combustion source is preferably disposed within the rod of smoking material and may for example be made of a carbonised material generally of the type proposed in U.S. Pat. No. 4,219,031, although not necessarily in the form of carbonised fibres. Our research has included extrudites of powdered activated carbons for the combustion source.

The combustion source may itself be located externally of the tobacco rod as a wrapper or sheath replacing the paper wrapper and providing the means of controlling combustion of the smoking material and also providing the combustion source for continuity between puffs.

In a further embodiment the combustion source may also be included as a mixture in the smoking material, for example, in the form of shreds or as a multiplicity of filaments.

The combustion source is preferably constructed of activated carbon and/or partly carbonised cellulosic material which preferably forms at least 50% by weight of the combustion source, the remainder may be inorganic fillers, binding agents such as pectin, quar gum or carboxymethylcellulose and combustion modifiers such as organic salts of the Group I and Group II metals and other fibres added for mechanical strength.

The invention and its properties will now be described merely by way of example with reference to the accompanying drawings in which.

Figure 1:
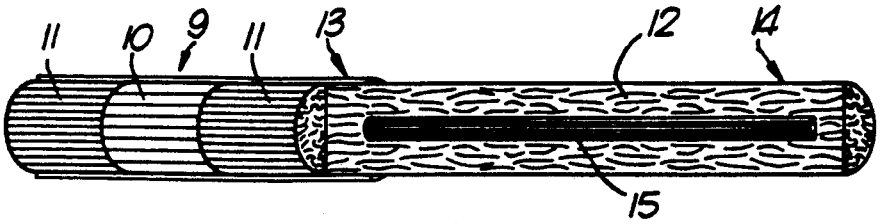
FIG. 1 is a diagrammatic cross sectional view through a cigarette made according to the present invention.

Referring to FIG. 1, there is shown a cigarette comprising a mouthpiece 9 comprising filter segments 10 and 11, attached to a rod 12 of tobacco by tipping paper 13. The rod 12 of tobacco is wrapped in a wrapper 14 which in this smoking article will not support self sustaining free smoulder of the smoking material. This may be achieved with a paper wrapper having a viscous flow, air permeability of less than 5 Coresta units (the concept of air permeability in cigarette paper is described in UK patent application GB 2094130A page 1, lines 31 -60 inclusive).

It may be desirable to enhance the airflows through the paper wrapper by means of perforation usually achieved by electrostatic or mechanical means, giving rise to increased smoke dilution but not substantially altering the gas diffusion characteristics of the wrapper. This mechanism enables an increase in the "total permeability" of the wrapper to levels consistent with or beyond the total permeability of wrappers of conventional cigarettes. These values may exceed 150 Coresta units and may even be as high as 200 Coresta units. (The concept of "total permeability" is described in GB2094130A page 1, lines 31–60 inclusive).

The consequence of choosing the wrapper 14 with these characteristics is to produce a tobacco rod 12 which ordinarily will not support free/static smoulder and will self-extinguish if left unpuffed.

Disposed within the tobacco rod 12 is a rod 15 constructed of activated carbon which forms at least 50% by weight of the constituent elements of this rod. The rod 15 may extend throughout the length of the tobacco rod 12 but as illustrated stops short of both ends in order to achieve benefits of appearance and fire safety.

The rod 15 may take the form of a rigid or flexible rod or filaments which may be formed by extrusion or moulding operations. The rod may be permeable or impermeable and may have an annular construction to aid gas flow through the void. Its cross section may be circular or any convenient regular or irregular shape designed to enhance surface contact area with the tobacco and air flows.

The size of rod 15 in cross section may be varied according to the application and this size variation may be used to vary the free burning time of the rod 15 between puffs.

The rod 15 is designed to provide a larger thermal mass than that of the surrounding tobacco so that it will continue to smoulder for the period between puffs whilst combustion in the surrounding tobacco is substantially quenched. The rod 15 is so constructed to provide a continuing heat source at least over the period allowed by the majority of smokers between puffs. It may not be desirable for the rod 15 to continue smouldering in the absence of any puffing action by the smoker until it is fully consumed, as this might present a fire hazard. Preferably it will self-extinguish as it recedes into the tobacco rod 12 and becomes progressively less accessible to oxygen and more influenced by heat losses to the surrounding tobacco. Thus the rod 15 will provide a conbustion source without a forced airflow caused by puffing for periods in excess of the normal free smoulder time between puffs imposed by most smokers, and be capable of propagating this combustion to the tobacco 12 on activation by puffing from the smoker.

Figure 3:
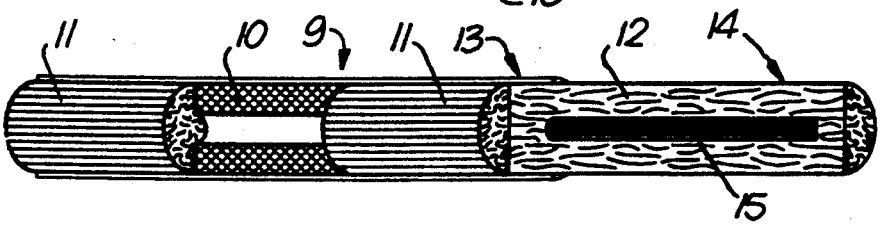
FIG. 3 is a cross sectional view through a diagrammatic representation of an alternative embodiment of a cigratte made according to the present invention so as to show alternative ways of using the advantage of reduced tobacco consumption.
Figure 4:
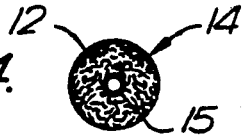
FIG. 4 is a cross sectional end elevation of the cigarette shown in FIG. 3.

The mouthpiece 9 may be a conventional single element or multi element filter or may be formed in the manner described in GB patent application No. 2210546 but as illustrated in FIG. 1 is a multiple filter element of usual proportions, whereas in FIG. 3 it is an elongated multiple filter element designed to provide more customary overall dimensions to the finished article. The filter elements 10, 11 may be constructed of filamentary material such as cellulose acetate, polypropylene or other non-filamentary filtering mediums, for example carbon. The filter elements may be open structure mediums, such as melt blown polypropylene, or cavities overwrapped with porous and/or perforated wrappers and tipping materials.

FIG. 3 represents an alternative construction in which the benefit of a reduced amount of tobacco consumed between puffs gives rise to an opportunity to shorten the length of the tobacco rod 14 required to achieve the same number of puffs as a conventional cigarette. In turn,this dimensional change provides greater scope in the design of the mouthpiece 9 such that it may be used, for example, as a medium for diffusion losses of carbon monoxide due to its extended surface area and increased residence time of the mainstream smoke passage.

The different dimensions of the tobacco rod 14 shown in FIGS. 1 and 3 are a consequence of choosing different levels of expanded tobacco and density combinations. Thus the cigarette may be constructed so as to have conventional or unconventional dimensions. However, compared with conventional cigarettes the benefits of this invention may be exploited to achieve tobacco savings whilst maintaining equivalent number of puffs irrespective of whether conventional or unusual dimensions are chosen.

The operation of the cigarette is as follows. Upon lighting the cigarette the tobacco at the lit end will be ignited and due to the forced airflow through the burn zone will cause pyrolysis to be propagated along the rod 12 thus forming combustion products divided between mainstream and sidestream emissions. Mainstream emissions will be inhaled by the smoker through the mouthpiece 9 and sidestream emissions will be lost to the surrounding atmosphere. When the smoker creases to draw on the cigarette, combustion of the smoking material will substantially cease due to the properties of the wrapper 14 or the combined effect of the wrapper, smoking material and fuel element, whilst the rod 15 will continue to provide a source of heat for a sufficiently long period of time to enable the smoker to regenerate combustion in the tobacco rod 12 upon puffing at the next occasion.

Between puffs, with the tobacco rod 12 subjected only to the heating effect of the rod 15, emissions of distillation and pyrolysis products are substantially eliminated and thus virtually no sidestream emissions will be apparent. Weight loss plots shown in Example 4 described later confirm the virtual absence of combustion of the tobacco rod between puffs.

As soon as the smoker puffs on the cigarette, air will be drawn past the smouldering end of the rod 15 to cause a rapid rise in temperature which by virtue of the availability of oxygen from the forced airflow, readily propagates combustion to the adjacent tobacco reestablishing a burning tobacco zone. Thus mainstream and some sidestream smode will be generated in the usual way and in accordance with the needs of the smoker.

The majority of sidestream emission from conventional cigarettes is generated during the free smoulder period between puffs when 50% or more of the available tobacco is usually consumed. With cigarettes according to the present design most of the sidestream smoke normally generated between puffs is eliminated leaving virtually only those emissions which are associated with activation of the smoking article during and immediately following puffing. This behaviour is shown later in the diagrams of visible sidestream production in Example 7.

Thus, there is provided by the embodiment of FIG. 1 a cigarette which is adapted to extinguish the smoking material between puffs, thereby not generating appreciable sidestream emissions between puffs and furthermore adapted to reignite by activiation through puffing to generate combustion products in accordance with the needs of the smoker. Thus the smoking material remains substantially unburnt between puffs, burning most of the smoking material during puffs. Compared with a cigarette of conventional construction there is a substantial reduction in the total amount of tobacco that needs to be pyrolised to meet the requirements of the smoker. Thus, to provide the equivalent 9 puffs (on a smoking machine at standard conditions) of a convnetional cigarette with a tobacco rod 59 mm in length, a smoked tobacco rod portion of only about 21 mm in length is sufficient with cigarettes made according to the present invention at equivalent tobacco rod density (Table 3). Alternatively, expanded tobacco may be used at levels up to 100% to achieve reduced density and increased length whereby the equivalent weight of tobacco of the Table 3 tobacco rod is consumed (Table 1). As a consequence of this invention consumption of the tobacco has become much less dependent on time and much more dependent on puff number when compared with conventional cigarettes.

It will be appreciated that the generation of side-stream emissions will be determined by the characteristics of the paper wrapper 14, the tobacco 12 and the combustion source 15, which combine to detemine the rate at which combustion will propagate to the tobacco 12 and thereafter cease to smoulder.

The invention will be described with reference to seven Examples, details of which are set out in Table 1.

which serves to illustrate the ability to manipulate and indeed prescribe the desired extinguishing time for the smoking article.

Since the fuel rods were extruded to a constant density, increases in fuel rod weight were achieved via cross-sectional area and may also suggest a dimensional dependency of the extinguishing time.

Figure 11:
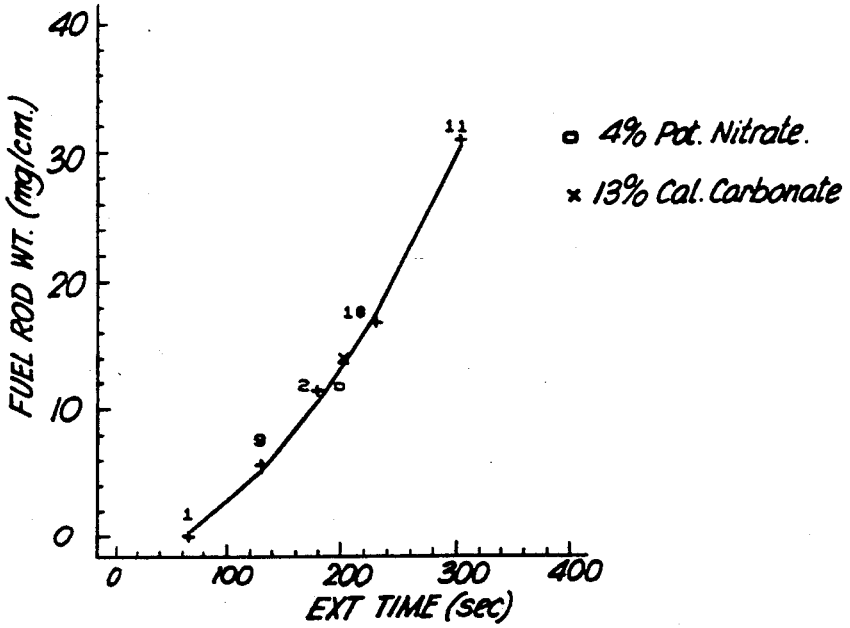
FIG. 11 is a graph of extinguishing time versus fuel rod weight per unit length for the cigarettes of example 1.

Also shown in FIG. 11 are examples of a fuel rod containing further additives such as potassium nitrate or calcium carbonate which modify combustion and/or ash appearance of the fuel rod.

TABLE 1

| | Cigarette Details | | | | | Fuel Element Details | | |
|---|---|---|---|---|---|---|---|---|
| Type No. | Tobacco Type | Circ. mm | ODD $kg^{m-3}$ | Strand Width mm | Cig. Wrap Type | Weight mg/cm | O.D. (mm) | I.D. (mm) |
| | Example 1 | | | | | | | |
| 1. | Expanded | 24.8 | 143 | 0.7 | A | — | None | — |
| 9. | Expanded | 24.8 | 143 | 0.7 | A | 5.6 | 1.0 | 0 |
| 2. | Expanded | 24.8 | 143 | 0.7 | A | 11.4 | 1.8 | 0.8 |
| 10. | Expanded | 24.8 | 143 | 0.7 | A | 16.8 | 2.2 | 1.0 |
| 11. | Expanded | 24.8 | 143 | 0.7 | A | 30.9 | 2.8 | 1.1 |
| | Example 2 | | | | | | | |
| 1. | Expanded | 24.8 | 143 | 0.7 | A | — | None | — |
| 2. | Expanded | 24.8 | 143 | 0.7 | A | 11.4 | 1.8 | 0.8 |
| 3. | Expanded | 24.8 | 178 | 0.7 | A | — | None | — |
| 4. | Expanded | 24.8 | 178 | 0.7 | A | 11.4 | 1.8 | 0.8 |
| 5. | Unexpanded | 24.8 | 231 | 0.5 | A | — | None | — |
| 6. | Unexpanded | 24.8 | 231 | 0.5 | A | 11.4 | 1.8 | 0.8 |
| 7. | Cut Rolled Stem | 24.8 | 201 | 0.3 | A | — | None | — |
| 8. | Cut Rolled Stem | 24.8 | 201 | 0.3 | A | 11.4 | 1.8 | 0.8 |
| | Example 3 | | | | | | | |
| 12. | Unexpanded | 21.1 | 234 | 0.5 | A | — | None | — |
| 13. | Unexpanded | 21.1 | 234 | 0.5 | A | 11.4 | 1.8 | 0.8 |
| | Example 4 | | | | | | | |
| 14. | Players Med. N.C. | 25.2 | 247 | 0.7 | PMNC | — | None | — |
| 15. | Expanded | 24.8 | 150 | 0.7 | PMNC | — | None | — |
| 2. | Expanded | 24.8 | 143 | 0.7 | A | 11.4 | 1.8 | 0.8 |
| 16. | Expanded | 25.1 | 139 | 0.7 | A | 11.4 | 1.8 | 0.8 |
| | Example 5 | | | | | | | |
| 17. | Expanded | 24.8 | 143 | 0.7 | A | 11.4 | 1.8 | 0.8 |
| 18. | Embassy Mild | 24.8 | 234 | 0.7 | Emb. Mild | — | None | — |
| 19. | Vantage Excel | 24.9 | 142 | — | Vantage | — | None | — |
| | Example 6 | | | | | | | |
| 20. | Expanded | 25.1 | 139 | 0.7 | A | 11.4 | 1.8 | 0.8 |
| | Example 7 | | | | | | | |
| 17. | Expanded | 24.8 | 143 | 0.7 | A | 11.4 | 1.8 | 0.8 |
| 18. | Embassy Mild | 24.8 | 234 | 0.7 | Emb. Mild | — | None | — |
| 19. | Vantage Excel | 24.9 | 142 | — | Vantage | — | None | — |
| | Example 8 | | | | | | | |
| 21. | Expanded | 24.8 | 110 | — | B | — | None | — |
| 22. | Expanded | 24.8 | 110 | — | B | 11.4 | 1.8 | 0.8 |

A. The cigarettes paper wrapper has been chosen to achieve the self extinguishing characteristics of the tobacco rod described in this specification.

B. The cigarette's paper wrapper has been chosen to initally have the same properties as for A, but subsequently treated with a burn modifier to promote free smoulder.

Composition of all the fuel elements was by weight 88% activated carbon, 2% potassium citrate and 10% sodium carboxymethyl cellulose.

EXAMPLE1

Experiment (a)—Time to Extinguish during Static Smoulder

Test cigarettes detailed as types 1, 2, 9, 10, 11 in Table 1 were smoked according to the following regime. Each cigarette was lit by a 35 ml. puff of 2 seconds duration and 30 second allowed to elapse before a further puff taken, whereafter the time taken to complete visual extinguishing of the sample under subdued lighting was recorded. The procedure was replicated 4 times per sample rod (i.e. relit) and for 4 samples to achieve an overall mean value.

In FIG. 11 mean replicate extinguishing time is plotted against sample fuel rod weight per unit length

Experiment (b)—Time to Extinguish During Smoking Tests

Cigarettes were observed whilst being smoked on a 10 port smoking machine, to detemine the proportion that extinguished before being fully smoked.

The puff volume and duration, 35 ml and 2 seconds respectively, were the same for all the smokings.

The interval between puffs was increased on successive smoking runs of individual cigarette types, until all the cigarettes extinguished before being fully smoked. The cigarettes were considered to be fully smoked if they did not extinguish before a pre-detemined length was burned. This length was set to produce a similar puff number to commercial cigarettes.

Ten cigarettes of each type were smoked with, and without, a carbon fuel element inserted.

The cigarettes were made in groups to investigate specific factors.

Those listed in Table 1 for Example 1 used the same tobacco rod but varied with regard to the detail of the fuel element.

The general conclusion is that the fuel element extends the interval between puffs for which cigarettes can be fully smoked and has been shown to do so for many different tobacco rods.

Figure 12:
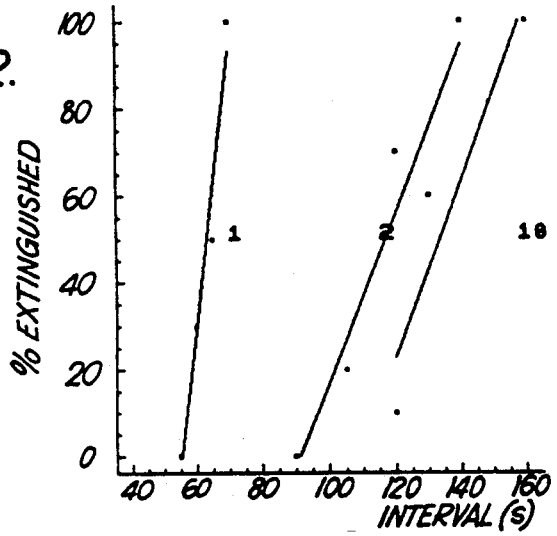
FIGS. 12 to 17 are graphs of % extinguished versus interval between puffs for the cigarettes of examples 1, 2, and 3.
Figure 13:
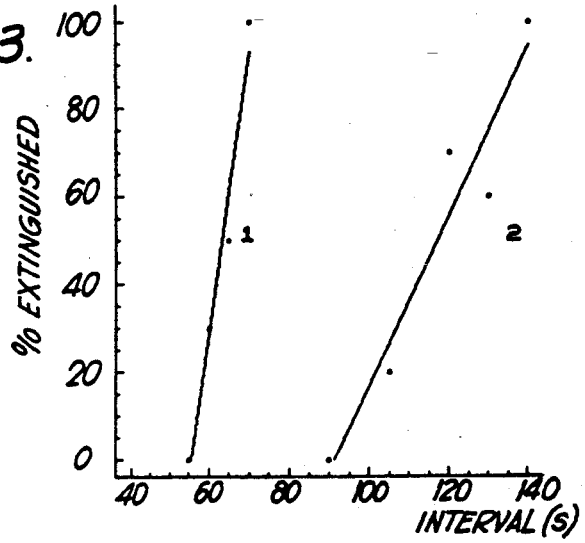
Figure 14:
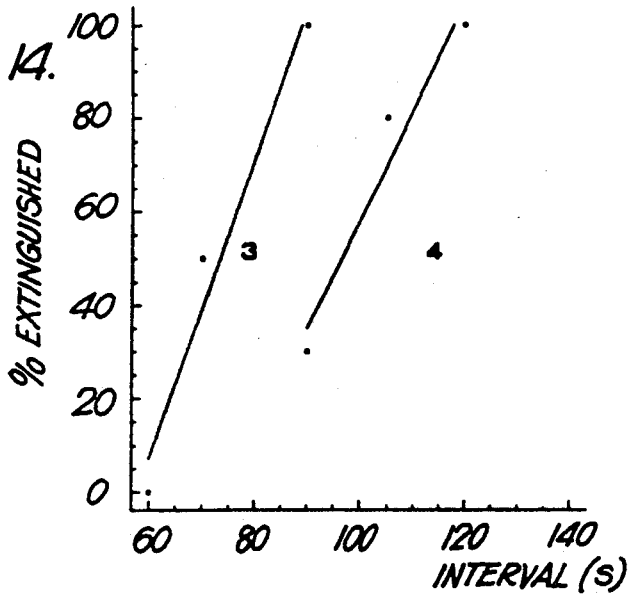
Figure 15:
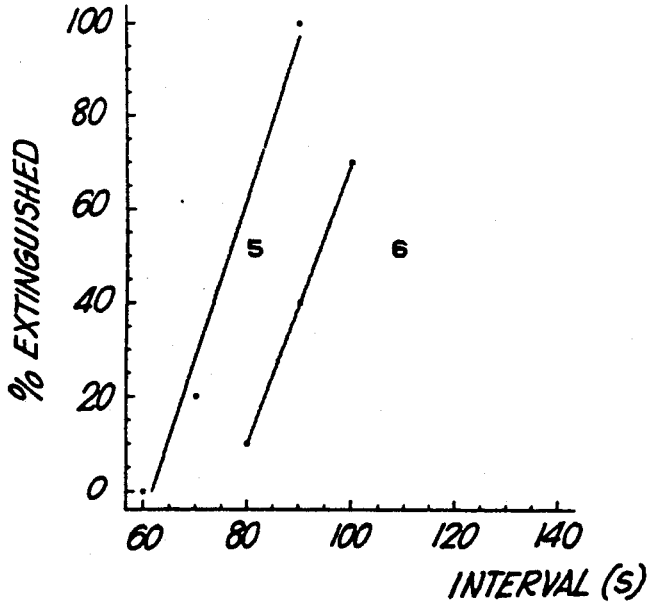
Figure 16:
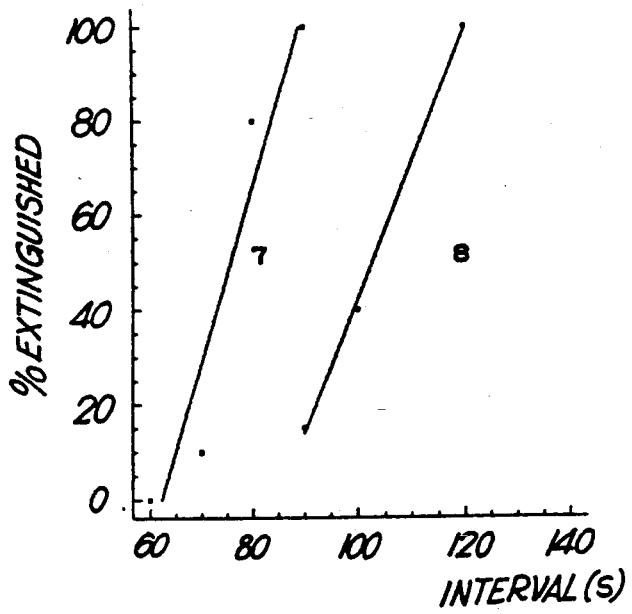

The measurements made on the cigarettes in Example 1 show that the interval can be further increased by the use of a fuel rod of increased weight per unit length (see FIG. 12).

EXAMPLE 2

Cigarettes were observed whilst being smoked on a 10 port smoking machine, to determine the proportion that extinguished before being fully smoked.

The puff volume and duration, 35 ml and 2 seconds respectively, were the same for all the smokings.

The interval between puffs was increased on successive smoking runs of individual cigarettes types, until all the cigarettes extinguished before being fully smoked. The cigarettes were considered to be fully smoked if they did not extinguish before a predetermined length was burned. This length was set to produce a similar puff number to commercial cigarettes.

Ten cigarettes of each type were smoked with, and without, a carbon fuel element inserted.

The cigarettes were made in groups to investigate specific factors.

Those listed for Example 2 were dimensionally identical and used the same fuel element specification, but were made with various tobacco types.

The general conclusion is that the fuel element extends the interval between puffs for which cigarettes can be fully smoked and has been shown to do so for many different tobacco rods.

The measurements made on the cigarettes in Example 2 show that the extended interval can be obtained when using tobacco which has been processed in different ways. (See FIGS. 13 to 16).

EXAMPLE 3

Cigarettes were observed whilst being smoked on a 10 port smoking machine, to determine the proportion that extinguished before being fully smoked.

The puff volume and duration, 35 ml and 2 seconds respectively, were the same for all the smokings.

The interval between puffs was increased on successive smoking runs of individual cigarette types, until all the cigarettes extinguished before being fully smoked. The cigarettes were considered to be fully smoked if they did not extinguish before a predetermined length was burned. This length was set to produce a similar puff number to commercial cigarettes.

Ten cigarettes of each type were smoked with, and without, a carbon fuel element inserted.

The cigarettes were made in groups to investigate specific factors.

Those listed for Example 3 were made at a reduced circumference.

The general conclusion is that the fuel element extends the interval between puffs for which cigarettes can be fully smoked and has been shown to do so for many different tobacco rods.

Figure 17:
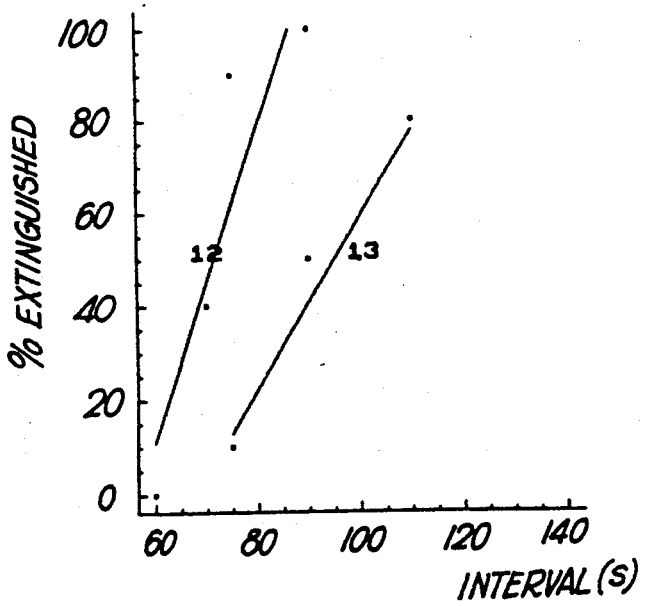

The measurements made on the cigarettes in Example 3 show that the extended interval can be obtained when the circumference of the tobacco rod is reduced. (See FIG. 17).

EXAMPLE 4

Plain 62 mm sample rods of test cigarettes detailed as types 2, 14, 15, 16 in Table 1 were smoked according to the following conditions. Each sample was suspended on a computer based digital balance and continuously weighed while being puffed via a flexible tube by a 35 ml puff or 2 seconds duration and 1 minute cycle.

Figure 18:
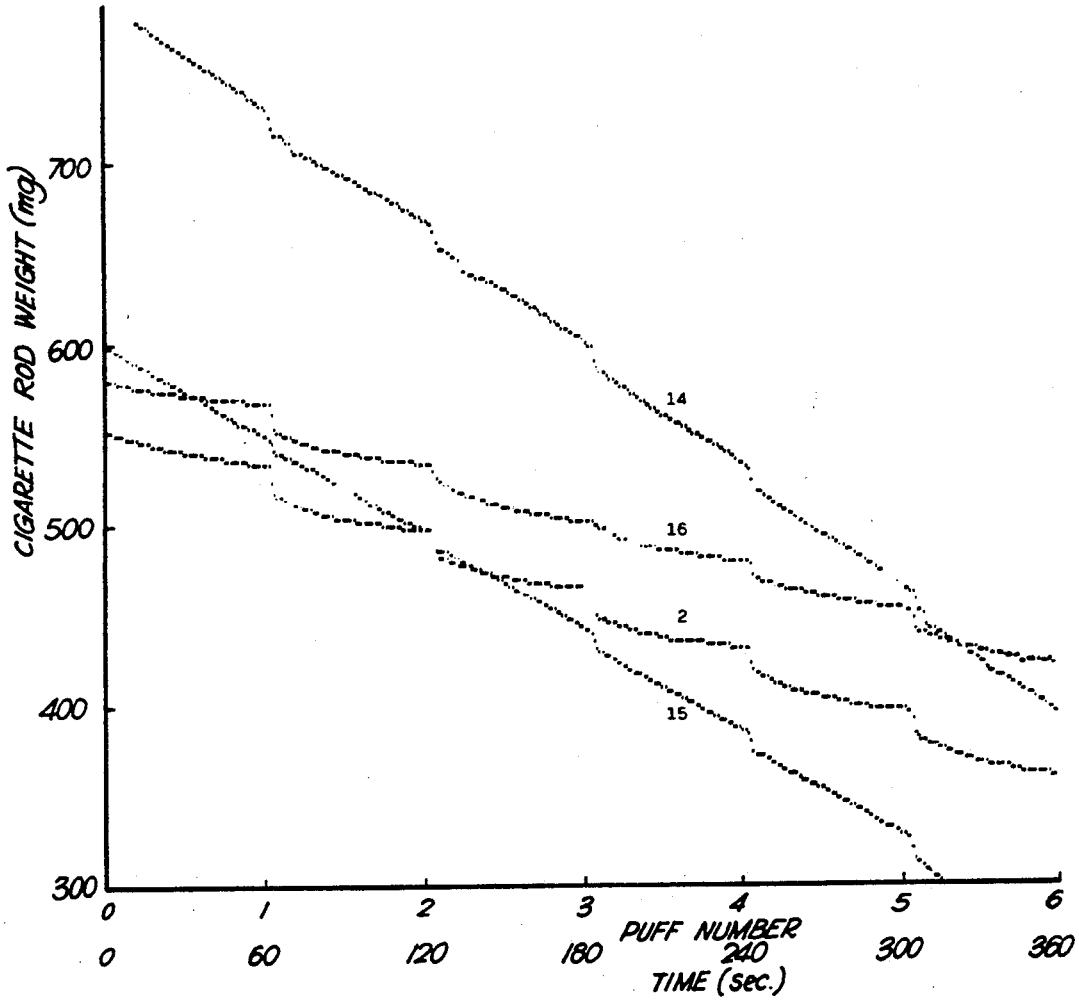
FIG. 18 is a graph of cigarette rod weight versus puff number for the cigarettes of example 4.

In FIG. 18 the weight profiles are shown with respect to puff number and time. Types 14 and 15 demonstrate the weight profiles for samples constructed with conventional cigarette paper and design at two tobacco densities, whereas types 2 and 16 represent examples according to the invention. The profiles for types 2 and 16 clearly demonstrate a significant reduction in the weight loss between puffs, predominantly due to the rapid cessation of tobacco combustion during the interval following a puff.

This is further illustrated in Table 2 by the reduction in average rate of weight loss between 10 and 50 seconds after puffing for types 2 and 16.

TABLE 2

| Sample Type | Average Puff Interval Weight Loss Rate mg/sec |
|---|---|
| 14 | 0.94 |
| 15 | 0.81 |
| 2 | 0.35 |
| 16 | 0.32 |

EXAMPLE 5

The following method was used to determine the visible intensity sidestream emissions for sample cigarettes types 17, 18, 19 detailed in Table 1.

Figure 19:
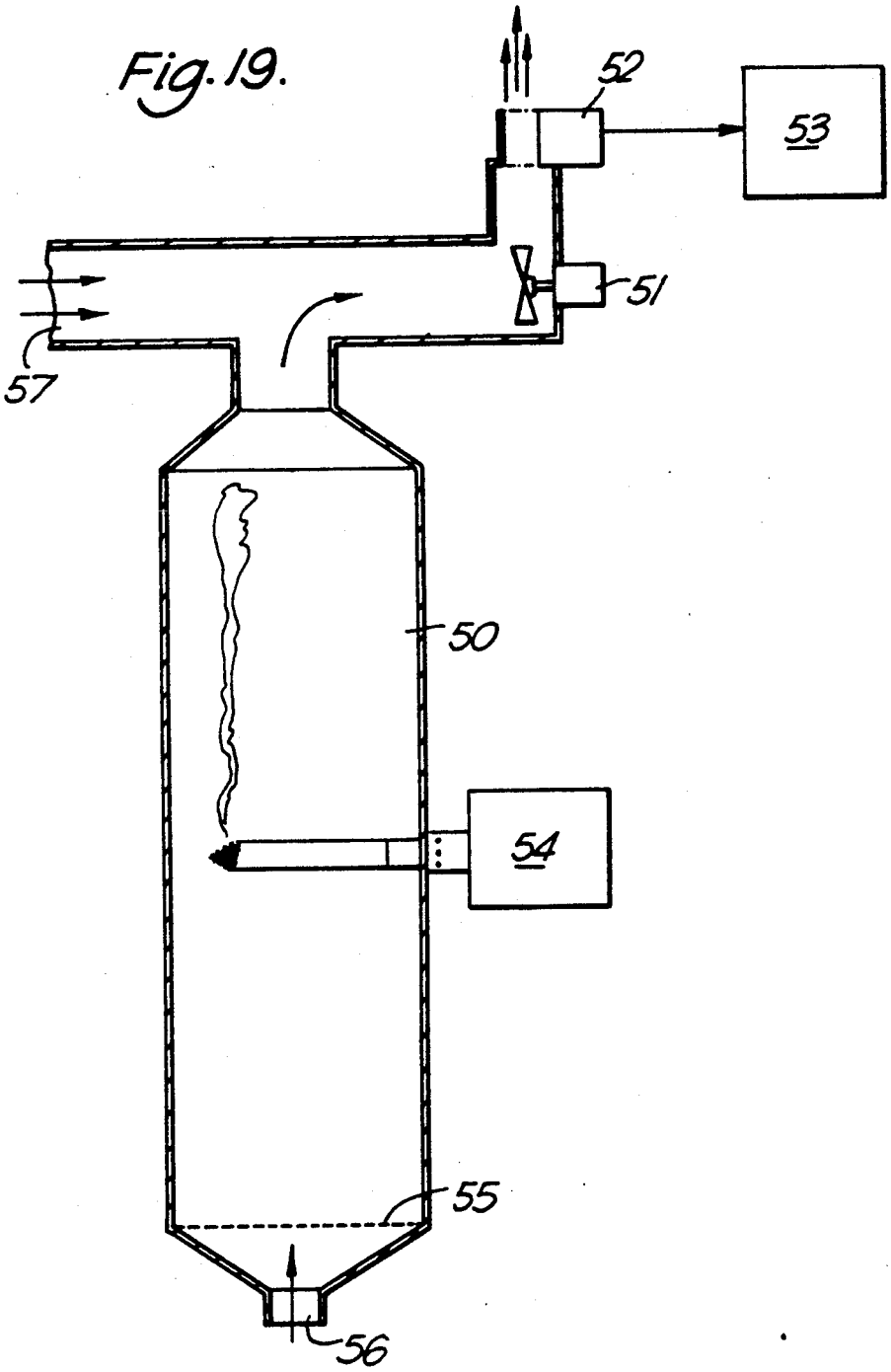
FIG. 19 is a schematic side view of the test equipment used in example 5.

Sample cigarette tobacco rods were enclosed in a cylindrical perspex tube 50 having a paper tissue 55 over its lower end to diffuse the air flow at the chamber air inlet 56. The cigarettes were puffed externally by a 35 ml volume 2 second duration and 1 minute cycle smoking machine 54 as illustrated schematically in FIG. 19. An impeller fan 51 mixed and diluted the emitted cigarette sidestream smoke with free air from inlet 57 and also provided a small laminar extraction air flow over the cigarette located in the tube. The diluted sidestream smoke/air mixture was passed into an optical light scattering aerosol monitor 52 (GCA Corporation USA) from which a signal output was data-logged into a computer 53 at a rate of 2 samples/sec.

Figure 20:
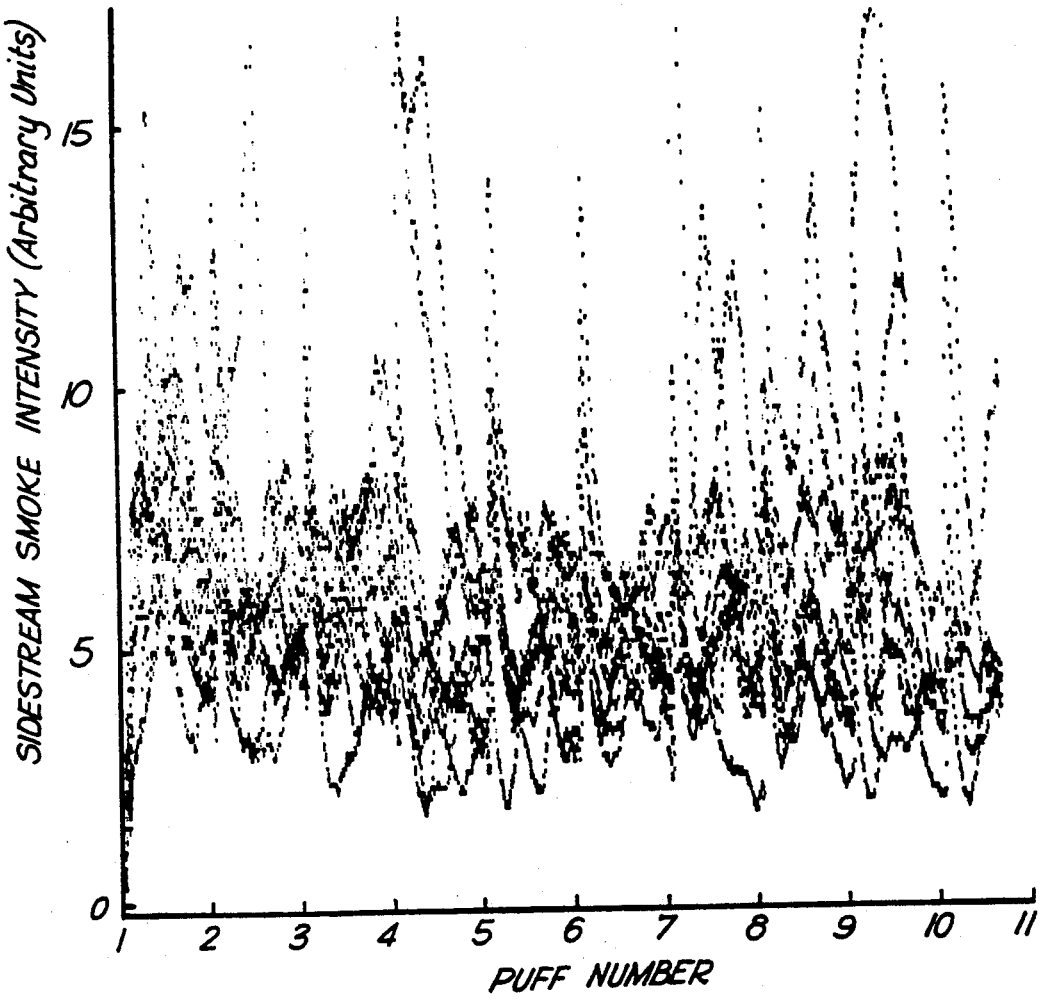
FIGS. 20 to 22 are graphs of sidestream smoke intensity versus puff number for the cigarettes of example 5.
Figure 21:
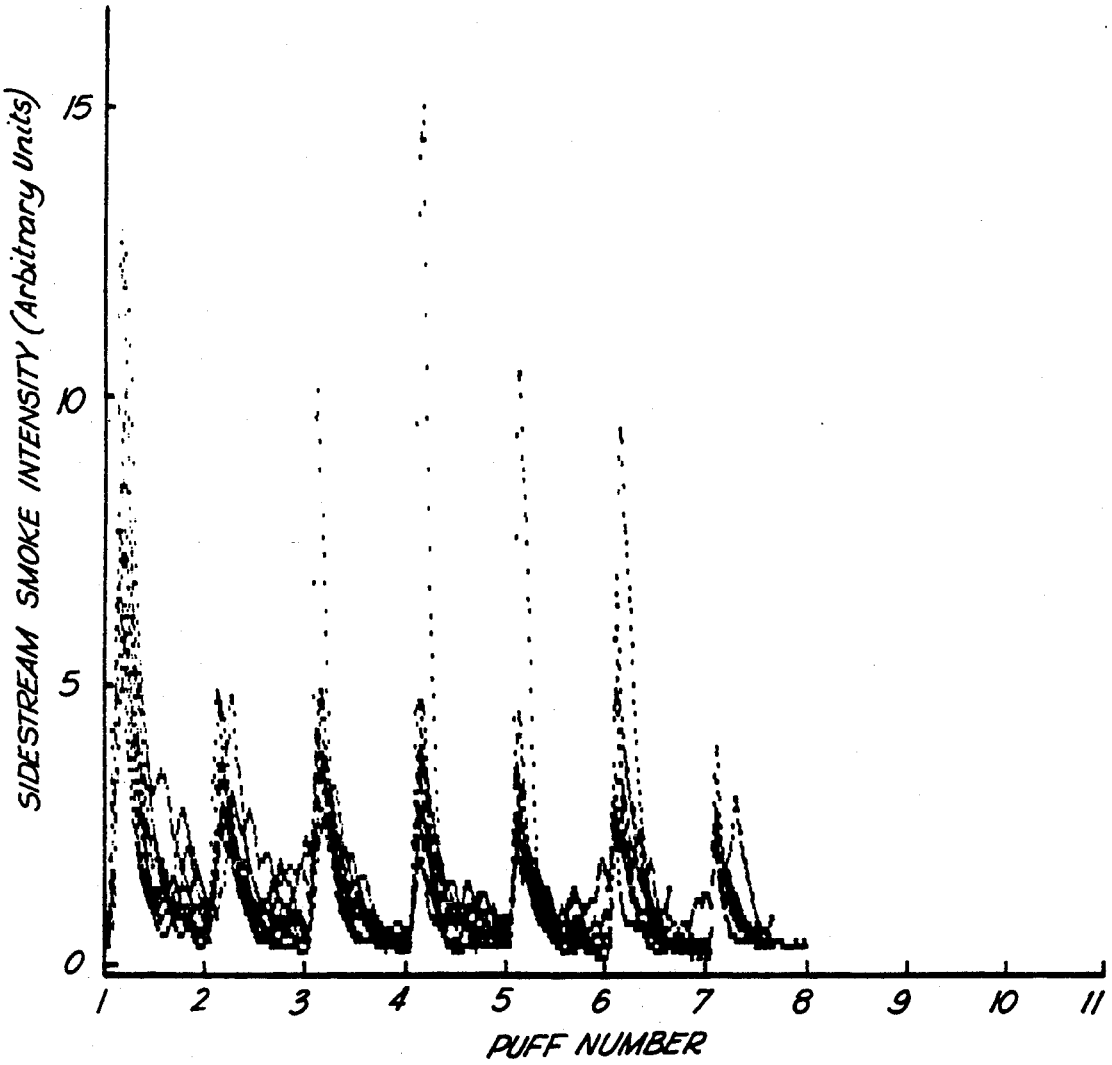
Figure 22:
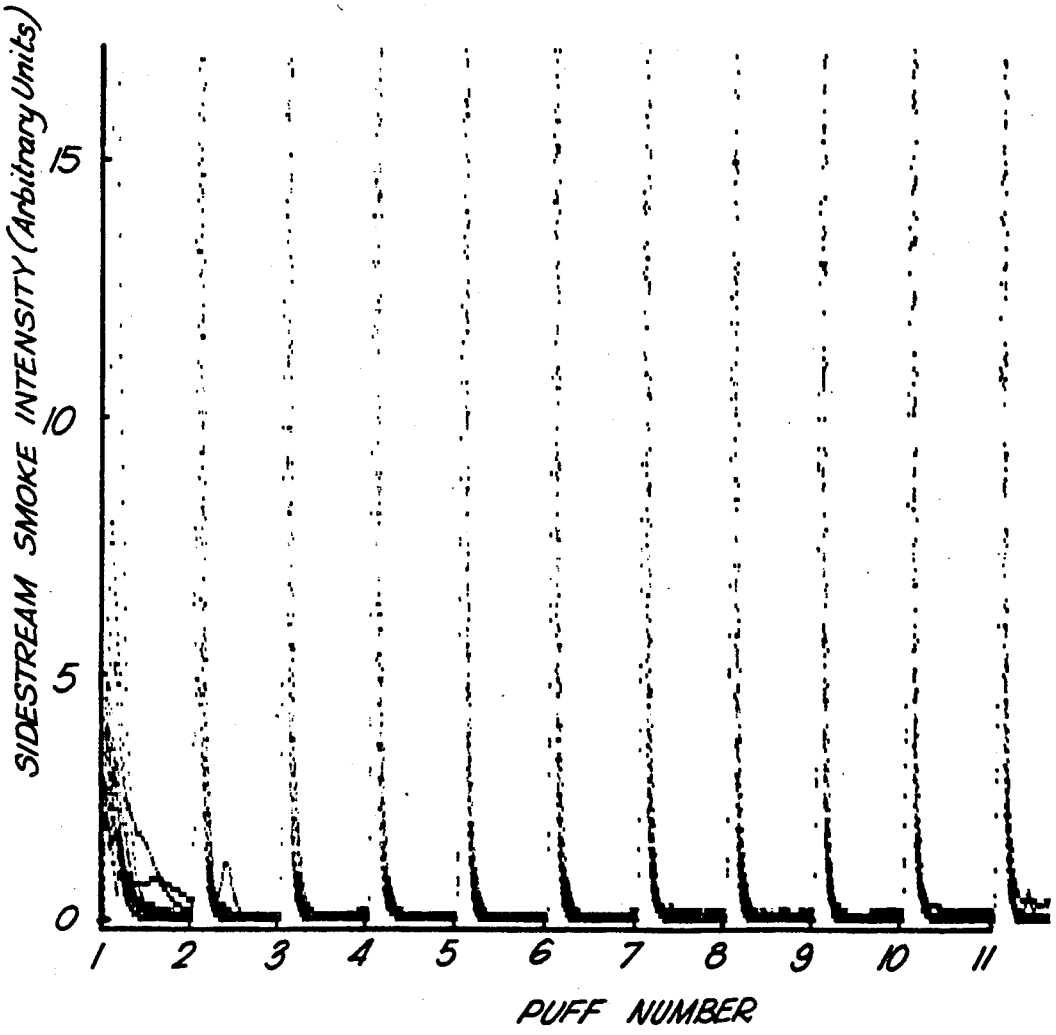

In FIGS. 20, 21, 22 the plots of sidestream smoke intensity emissions are given with respect to puff number, for 10 replicate smokings of cigarette types 18, 19, 17 respectively. Ten replicate measurements are superimposed in each figure. FIG. 20 illustrates the typical high intensity and random sidestream smoke emissions from conventional commercial cigarettes (Type 18). In FIG. 21 the sidestream smoke emissions for commercial products with reduced sidestream smoke are shown (Type 19). The sidestream emissions from this cigarette type are characterised by a high peak of sidestream emission during a puff followed by a reduced level of emission during the interval between puffs compared with FIG. 20, Type 18. However, measurements on cigarettes according to the invention (Type 17), (illustrated in FIG. 22), show a high peak of sidestream emission during a puff which decays more rapidly and consistently to a lower level than for Type 19 between puffs as combustion of the tobacco ceases.

The ideal graph of sidestream smoke intensity versus puff number according to the present invention would show a peak during puffing and an instantaneous return to zero between puffs. The example used (Type 17) is clearly very close to this ideal.

It will of course be realised that it is essential for the Type 19 cigarette not to extinguish itself during standard puff intervals because there is provided no means to reignite it. Although the sidestream intensity decays, it clearly decays much slower than the Type 17 cigarette and does not approach the minimum values of sidestream intensity exhibited by the Type 17 cigarette.

EXAMPLE 6

Figure 23:
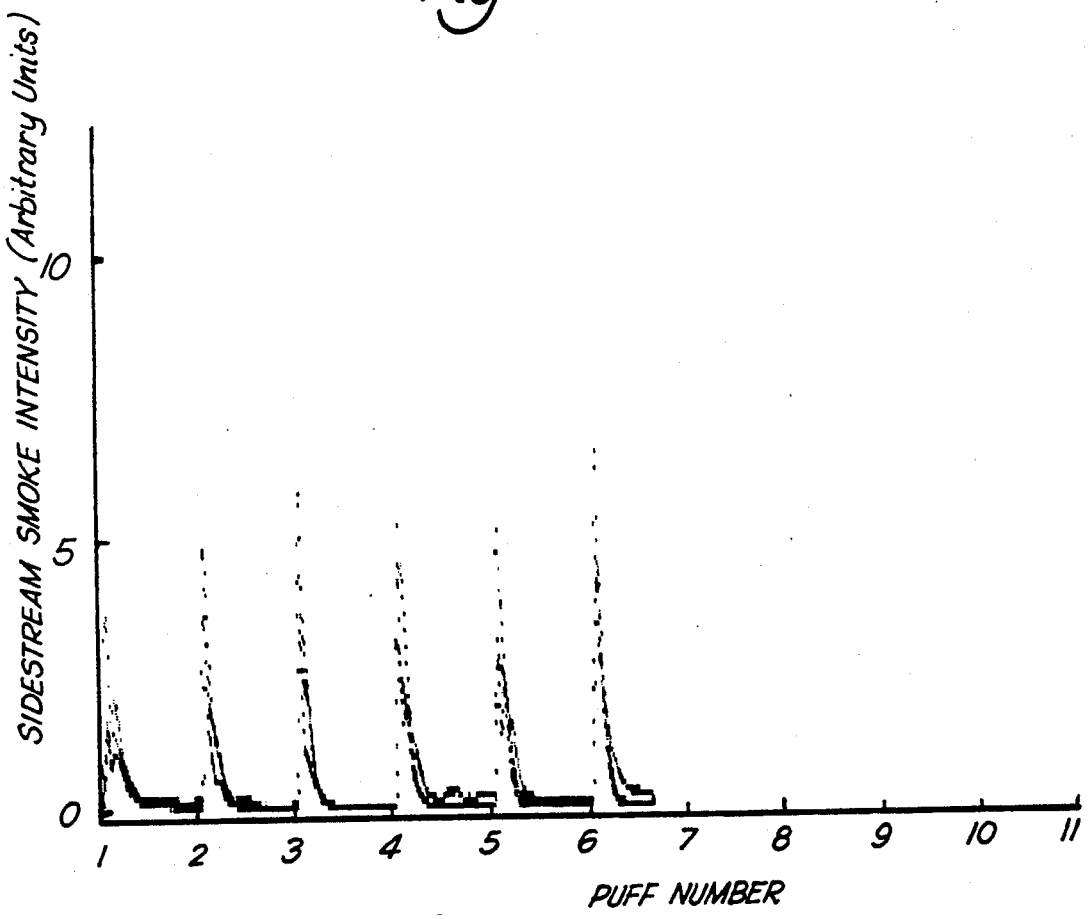
FIG. 23 is a graph of sidestream smoke intensity versus puff number for the cigarette of example 6.

Cigarette samples of type 20 detailed in Table 1 were constructed with cigarette wrappers according to the invention to which tripotassium citrate (3.6 wt %) was applied to the external surface. Visible sidestream emissions were measured for 3 replicates from the initial 6 puffs according to the method in Example 5. It was found that the additive improved paper char line uniformity and ash formation and significantly reduced the peak sidestream emissions during puffs as illustrated in FIG. 23.

EXAMPLE 7

Simultaneous Measurement of Sidestream and Mainstream Particulate Matter Deliveries In order to collect sidestream total particulate matter (TPM), cigarettes were smoked inside a chamber with the top closed by a glass fibre filter pad. An airflow of 3 liters per minute was maintained through the chamber, which was rectangular in cross-section (7.2 cm×8.98 cm). The cigarettes were inserted into a cigarette holder located 10 cm below the filter pad for smoking. The holder was connected to a smoking machine set to take a 35 ml. puff of 2 seconds duration every minute.

Mainstream particulate matter was collected for measurement on a filter pad incorporated in the cigarette holder.

Three cigarette types (Example 7) were assessed. These were:

Type 17—an experimental product with a carbon fuel element

Type 18—a conventional commercial product

Type 19—a commercial product with reduced sidestream delivery

The results achieved are shown in Table 3.

TABLE 3

| | | | Mainstream and Sidestream Deliveries | | | | |
|---|---|---|---|---|---|---|---|
| | | | Mainstream | | | Sidestream | |
| Type | | No. of Puffs | TPM (mg cig$^{-1}$) | PWNF (mg cig$^{-1}$) | NICOTINE (mg cig$^{-1}$) | TPM (mg cig$^{-1}$) | TPM (mg min$^{-1}$) |
| 19 | Mean | 6.3 | 11.4 | 9.6 | 0.90 | 8.3 | 1.31 |
| | S.D. | (0.5) | (1.9) | (1.8) | (0.08) | (0.9) | (0.09) |
| | N | (30) | (10) | (10) | (10) | (10) | (10) |
| 18 | Mean | 9.0 | 9.4 | 7.8 | 0.92 | 20.8 | 2.32 |
| | S.D. | (0.4) | (0.9) | (0.9) | (0.06) | (1.1) | (0.12) |
| | N | (24) | (7) | (7) | (8) | (8) | (8) |
| 17 | Mean | 13.8 | 6.6 | 5.7 | 0.54 | 7.6 | 0.55 |
| | S.D. | (1.0) | (0.8) | (0.8) | (0.08) | (0.7) | (0.05) |
| | N | (29) | (9) | (8) | (9) | (9) | (9) |

TPM = Total Particulate Matter
PWNF = Particulate Matter, Water & Nicotine Free
S.D. = Standard Deviation
N = Sample Size The cigarettes need to be compared with regard to both the delivery per cigarette and the rate of production of sidestream particulate matter.

On a per cigarette basis, Types 17 and 19 have a comparable sidestream TPM delivery which is much reduced on the conventional commercial product Type 18.

On a rate of production basis, the rate of sidestream TMP production from Type 17 is much reduced on that for Type 19.

EXAMPLE 8

The aim of this example was to study the modification of the extinguishing characteristics of tobacco rods by the use of a burn modifier on the cigarette wrapper. The paper wrapper, a type which would normally cause a tobacco rod to self extinguish, was treated with a burn modifier, tri-potassium citrate. The resultant additive level was 6.3% of the weight of the paper.

When the cigarette Types 21 and 22 were lit by a 35 ml puff of 2 seconds duration it was found that Type 21 would free smoulder to burn a predetermined length of tobacco rod (48 mm) whereas 65% of the Type 22 cigarettes extinguished.

The addition of the burn modifier to the paper wrapper has therefore promoted free smoulder, and thus prevented the tobacco rod from self extinguishing when no fuel element was present (Type 21). However, further modification of the cigarette by the inclusion of the fuel element (Type 22) restricted free smoulder and caused a high proportion of the cigarettes to self extinguish. The Type 22 cigarettes are therefore extinguishing due to the combination of the wrapper and fuel element used in their construction.

Figure 2:
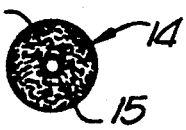
FIG. 2 is a cross sectional end elevation of the cigarette of FIG. 1.
Figure 6:
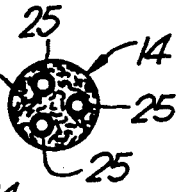
FIG. 6 is a cross sectional end elevation through the cigarette of FIG. 5.
Figure 5:
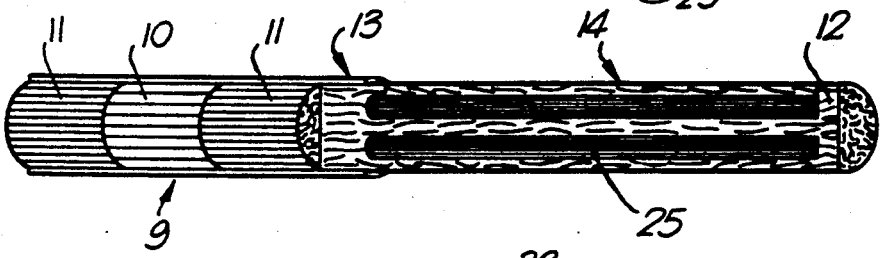
FIG. 5 is a diagrammatic cross sectional view through an alternative embodiment of a cigarette made according to the present invention.

In FIGS. 5 and 6 there is shown an alternative embodiment of a cigarette according to the present invention. The construction is identical to that of FIGS. 1 and 2 except that the rod 15 is replaced with three rods 25 of identical material and construction, although somewhat smaller in diameter compared to those described in FIGS. 1 and 2. The operation of the cigarette is identical to that of FIGS. 1 and 2 and the same benefits are achieved. The provision of three rods improves the reignition and propogation of the combustion to the tobacco rod when the smoker puffs on the cigarette.

Figure 8:
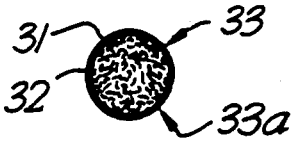
FIG. 8 is a cross sectional end elevation through the cigarette of FIG. 7.
Figure 7:
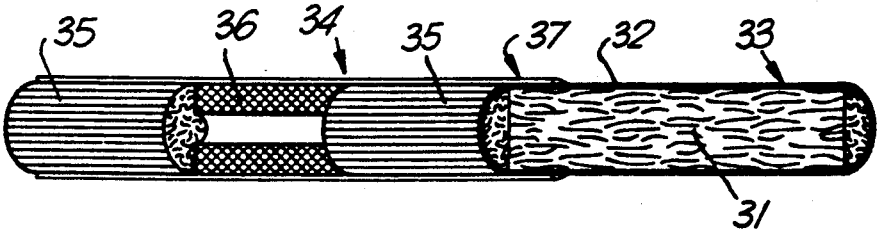
FIG. 7 is a diagrammatic cross sectional view through an alternative embodiment of a cigarette made according to the present invention.

Referring to FIGS. 7 and 8 of the drawings, there is shown an alternative embodiment in which a cigarette comprises a core 31 of conventional cigarette tobacco surrounded by a shell 32. The shell is press moulded from a mixture of 86% activated carbon powder and 12% sodium carboxymethylcellulose the press moulding being effected at a pressure of 320 lbs per square inch.

The shell 32 is externally coated with a coating 33 consisting of a mixture of 90% calcium carbonate and 10% sodium carboxymethylcellulose.

Cigarette paper 33*a* may be used to overwrap the coated shell 32. A mouthpiece 34 comprising conventional filter segments 35 and a hollow tube 36 is connected to one end of the combined core 31 and shell 32 by conventional tipping paper 37.

The mass of the shell 32 will be seen to be substantial compared with that of conventional paper wrappers. For example, the mass of the example shown in FIGS. 7 and 8 is 190 mg which compares with a mass of, say, 23 mg for a conventional cigarette paper wrapper.

The mass of the shell is substantial compared with the mass of the tobacco within the cigarette rod 31 and preferably constitutes at least 20% and preferably at least 35% of the combined mass of tobacco 31 and shell 32.

The shell 32 also constitutes a substantial proportion of the cross sectional area of the smoking product. The shell preferably constitutes at least 20% of the cross sectional area and in a preferred embodiment at least 30%.

By forming the shell 32 as a substantial heat source with a low static combustion rate the shell assumes the role of controlling the rate of static combustion of the tobacco rod during the static burn and thereby assuming full control of that process. By so controlling the static burn the sidestream smoke which is normally produced by the combustion of tobacco during the static burn can be substantially reduced or even eliminated. By forming the shell of virtually smokeless fuel no sidestream smoke will be produced by the static burn of the shell itself and with little, if any, combustion of the tobacco rod during the static burn period between puffs substantial reductions in the sidestream smoke will be achieved.

The shell 32 is designed to substantially deny oxygen to the tobacco rod 31 and thus after a puff the tobacco will quickly cease to combust and any combustion products will quickly disperse whilst the shell 32 will continue to smoulder at its static burn rate whilst denying oxygen to the tobacco rod 31. Cessation of tobacco combustion will also be influenced by the peripheral mass of carbon downstream of the tobacco coal acting as a heat sink. As soon as a further puff is taken on the cigarette, oxygen will pass into the tobacco rod 31 and in moving past the shell 32 will substantially increase the temperature of the smouldering shell and this increase in temperature will cause reignition and combustion of the tobacco 31. The continued ingress of oxygen caused during puffing will combust the tobacco forming combustion products which will pass to the mouth of the smoker via mouthpiece 34. Once the puff ceases, insufficient oxygen will pass into the tobacco rod 31, and being denied access by the shell 32 the tobacco will quickly cease to smoulder and smouldering will be assumed by the shell 32 as before until the next puff is taken. As described above, substantial reductions in sidestream smoke are achieved using this construction.

EXAMPLE 9

In a typical product the mouthpiece 34 was 55 mm long, the tobacco core 31 and shell 32 with coating 33 were 35 mm long, the overall diameter of the product was 8.5 mm. The shell 32 had an overall diameter of 7.9 mm with a wall thickness of 0.6 mm and the coating 33 had a thickness of 0.3 mm.

The weight of tobacco within the rod 31 was 320 mg and the weight of the shell 32 was 190 mg.

In smoking this article a static burn rate of 0.03 mm per second was achieved compared with a figure of 0.08 mm per second for that of a conventional cigarette made of the same cigarette tobacco with conventional cigarette paper wrap.

The level of sidestream smoke, measured by an optical technique, was 94% lower than the sidestream smoke produced by a conventional cigarette using the same type of tobacco. In this example under industry standard smoking conditions a similar number of puffs and smoke delivery were obtained as with a conventional cigarette, and yet the tobacco rod was only 35 mm long compared with a conventional length of 59 mm.

The shell 32 can be made by moulding, forming or extruding from a range of suitable materials such as carbon, activated carbon, wood pulp, flax and may also include glass or mineral fibres or webbing, tobacco or tobacco derivatives. The shell may include binding agents such as ethylcellulose, methylcellulose, carboxymethylcellulose salts, starch, carob and guar gums. The shell may be wrapped in an additional paper cellulosic in origin, to aid the making process.

Chemical additives such as metal oxides, silicates, carbonates, nitrates, organic salts of the Group I and Group II metals may also be introduced to modify the burn rate. A foaming agent such as sodium bicarbonate, solid carbon dioxide, oxygen and nitrogen, together with heat, may be used in the process of producing suitable shells to act as wrappers for smoking products according to the present invention.

The coating 33 on shell 32 may also include thermally insulating materials such as metal oxides, silicates, carbonates, glass and mineral fibres to improve the fire safety aspects of the design.

The outer wrapper 33*a* may be conventional cigarette paper, according to co-depending patent application No. 8912238.6 or aluminium foil or other similar material to improve the appearance of the product. The outer wrapper may also be perforated.

Where the shell 32 is wrapped with a base cellulosic material it is preferred that the carbon content of the shell should be at least 90% by weight of the base cellulosic wrapper.

The mouthpiece 34 may be formed in the manner described in GB patent application No. 2210546 to produce a collapsible mouthpiece facilitating disposal after use.

The minimum size and weight is limited by physical strength considerations and the need for the shell to maintain static combustion in the absence of simultaneous combustion by the tobacco rod.

The maximum shell thickness is limited only by the overall size of the product and by draw resistance of the tobacco rod which is not expected to exceed 300 mm wg at a flow rate of 17.5 milliliters per second. The shell 32 must be designed with an inherent burn rate comparable to that of the tobacco core 31 such that during puffs, the shell and core burn ostensibly together but leaving it protruding beyond the core 31 and thus delaying oxygen to the core as soon as puffing ceases.

All of the products according to the present invention show remarkably low tobacco consumption rates due to the static burn of the tobacco itself being substantially reduced or even eliminated and therefore substantial savings in the weight of tobacco can be achieved. Since most tobacco is wasted in the static burn between puffs, the amount of tobacco within smoking articles according to the present invention can be reduced virtually to that tobacco which is consumed during puffs. Thus, the weight of tobacco can be reduced to that which is little more than that which the consumer will smoke during the usual puffs on a conventional cigarette without the waste between puffs.

Figure 10:
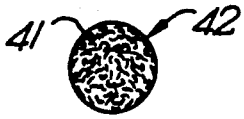
FIG. 10 is a cross sectional end elevation through the cigarette of FIG. 9.
Figure 9:
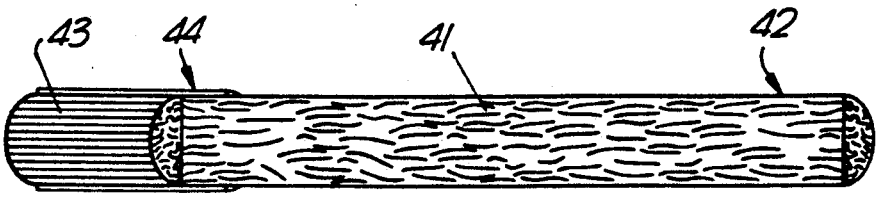
FIG. 9 is a cross sectional view through a conventional cigarette.

For the sake of comparison, a conventional cigarette is shown in FIGS. 9 and 10. The cigarette has a tobacco rod 41 wrapped in conventional paper 42. A cellulose acetate filter 43 is attached to the rod 41 by tipping paper 44. By comparision the cigarette of FIG. 9 has a tobacco rod length of 59 mm compared with a tobacco rod length of 35 mm in FIG. 3, both with similar weight per unit length of tobacco and producing similar number of puffs.

Cigarette products which 'self-extinguish' may be regarded as unacceptable to the smoker owing to the inconvenience of relighting and objections to the taste of drawing on an unlit cigarette. Thus previous proposals for reducing sidestream smoke incorporating low porosity and slow burning paper wrappers have drawn a balance between the slow smoulder of such devices and the need to keep the smoking material alight between puffs.

With the present invention there is provided a cigarette in which this need is avoided. The product preferably is of such slow burn characteristic that the tobacco is substantially extinguished and ceases to burn although still being heated by the combustion source. Thus there is no appreciable production of condensable sidestream vapours.

To achieve this objective, the alternative source of heat in the form of a combustion source capable of maintaining glow combustion for periods in excess of the normal free smoulder period between puffs and rapidly propogating this combustion to the surrounding smoking material when the oxygen supply increases during puffing, is provided in all the embodiments described above.

Combustion of the smoking material between puffs is substantially quenched, thereby providing a product in which the smoking material does not itself sustain static combustion.

Thus, there is provided with the present invention a product in which the smoking material substantially ceases to combust between puffs and so ceases to generate appreciable sidestream emissions during the static smoulder periods. The combustion source provided for continuity of ignition and which provides the heat source for reignition of the smoking material as soon as the smoker puffs on the product is in this case activated carbon formed with binding agents. It is this rapid reactivation of the smoking material which overcomes the objections to taste encountered when relighting a conventional cigarette.

In addition to the benefits outlined above in the form of low sidestream emissions, the products according to the invention with internal combustion sources would be expected to have an extremely low ignition proclivity as defined by contact tests used in the USA FIRE SAFETY STUDIES (1987). Thus by the nature of the smoking article described with reference to the embodiments of FIGS. 1–6, there is a substantial reduction in the period in which the peripheral tobacco is producing sufficient heat to propagate combustion to any contacting material such as furniture fabric. This reduced period of exposure will substantially reduce the possibility of an accidental fire. In particular, the absence of combustion of the tobacco surrounding the combustion source between puffs will substantially reduce the posibility of any accidental fire at the time when the risk is greatest, namely when the product is likely to be left unattended between puffs and allowed to smoulder. With the embodiment described in FIGS. 1–6 the present invention substantially avoids the presence of a peripheral hot coal in the smoking product between puffs and provides an insulating layer of substantially unburnt tobacco surrounding the combustion source between puffs such that the risk of contact with the combustion source in the event of careless disposal is reduced.

Similar benefits can be achieved with the embodiment of FIGS. 7 and 8 where the shell 32 is surrounded by appropriate heat insulating materials as described above in relation to those figures.

Articles made according to the present invention will also exhibit a substantial reduction in the quantity of tobacco needed to provide the smoker with the same dose level of combustion products compared with a conventional cigarette. Since the present invention confines most of the consumption of the smoking material to the period of the puff and 'wastes' very little of the smoking material by smouldering between puffs, a substantially reduced weight of smoking material can be used to provide the smoker with the equivalent dose level of combustion products as would be achieved with a conventional cigarette not made according to the present invention.

Furthermore, the present invention allows for greater flexibility of the duration over which a cigarette may be smoked since the consumption of the tobacco according to the present invention substantially depends upon the frequency and volume of puffs taken by the smoker and much less on the proportion of the time for which the cigarette is free smouldering, wherein a conventional cigarette normally consumes in excess of 50% and as much as 75% of the available tobacco weight.

It is our contention that the ideal smoking article is one in which the smoking material is only consumed during the puffing regime (whilst supplying the requirements of the smoker). The optimum solution minimises sidestream emissions, tobacco consumption and ignition proclivity. This invention provides a means of substantially achieving these benefits.

A smoking article in which the smoking material will continuously smoulder unassisted by puffing until fully consumed falls outside of this invention.

Conversely, this invention consists of a smoking article that does not provide this continuous unassisted smouldering in air, being adapted with an integral combustion source in addition to the smoking material in order to guarantee to the smoker a facility to reignite the smoking material during puffing and continue to do this for an acceptable period after the smoking material is substantially extinguished. The acceptable duration of this reignition facility will be market dependent, for example, a market predisposed towards low ignition proclivity may find that short durations will be most acceptable, whereas less sophisticated markets may require the converse. Key variables of the construction will be adapted to bring about this change. Examples of the variations which have been achieved are given in the experimental data.

What is claimed is:

1. A smoking article incorporating a rod of smoking material the combustion products of which are inhaled by the smoker by puffing, means extending substantially the length of the rod of smoking material for extinguishing the smoking material after each puff, and combustion source means which is distinct from and differs in composition from the smoking material, said combustion source being incorporated in the smoking article and extending substantially the length of the rod of smoking material to reignite the smoking material during each puff thereby causing the smoking material to combust.

2. An article as claimed in claim 1 further including a wrapper enclosing the rod of smoking material.

3. An article as claimed in claim 2 wherein the wrapper is of permeability and gas diffusion values below the values at which the wrapper would permit sufficient flow of oxygen to the smoking material to sustain static combustion in the absence of puffing.

4. A smoking article as claimed in claim 1 wherein the article is adapted to ignite by a rapid increase in temperature of the combustion source caused by the passage of air past the combustion source during puffing, combined with an increase in oxygen supply to the smoking material caused by puffing.

5. An article as claimed in claim 1 wherein more than about 50% by weight of the smoking material is consumed during puffs.

6. An article as claimed in claim 5 wherein substantially all the smoking material is consumed during puffs.

7. An article as claimed in claim 1 wherein if the smoking article is left unattended, the combustion source means will eventually extinguish before the whole article is consumed.

8. An article as claimed in claim 1 wherein the average sidestream Total Particulate Matter per minute is less than 1 milligram.

9. An article as claimed in claim 1 wherein the average sidestream Total Particulate Matter per minute is less than 0.6 milligram.

10. An article as claimed in claim 1 wherein the combustion source means is selected from the group consisting of activated carbon and partly carbonized cellulosic material.

11. An article as claimed in claim 1 wherein the combustion source means is disposed within the rod of smoking material.

12. An article as claimed in claim 1 wherein the combustion source means comprises at least one rod disposed within the smoking material.

13. An article as claimed in claim 2 wherein the wrapper is made of paper.

14. An article as claimed in claim 2 wherein the paper has a viscous flow air permeability of less than 5 Coresta units.

15. An article as claimed in claim 2 wherein the paper is treated with a burn modifier.

16. An article as claimed in claim 15 wherein the burn modifier is 6.3% by weight tri-potassium citrate, the fuel element has internal and external diameters of 0.8 and 1.8 mm respectively and weighs 11.4 g/cm, the smoking material is expanded tobacco having a density of 110 kg/m and a circumference of 24.8 mm.

17. An article as claimed in claim 1 wherein the combustion source means is spaced from the external circumferential surface of the article.

18. An article as claimed in claim 1 wherein the combustion source is a shell surrounding the smoking material which is in the form of a rod.

19. An article as claimed in claim 1 wherein the combustion source will reignite the smoking material after at least 60 seconds from the previous puff and preferably at least 120 seconds and more preferably at least 180 seconds.

20. An article as claimed in claim 1 including additive which reduces visible sidestream smoke emission.

21. An article as claimed in claim 1 wherein said means in said smoking article for extinguishing the smoking material after each puff comprises a wrapper.

22. An article as claimed in claim 1 wherein said means in said smoking article for extinguishing the smoking material after each puff comprises the smoking material.

* * * * *